US009854919B1

(12) United States Patent
Risdon

(10) Patent No.: US 9,854,919 B1
(45) Date of Patent: Jan. 2, 2018

(54) ILLUMINATED HEADBOARD

(71) Applicant: H.T.K. Design, LLC, High Point, NC (US)

(72) Inventor: Scott Mark Risdon, Greensboro, NC (US)

(73) Assignee: H.T.K. Design, LLC, High Point, NC (US)

( * ) Notice: Subject to any disclaimer, the term of this patent is extended or adjusted under 35 U.S.C. 154(b) by 0 days.

(21) Appl. No.: 15/465,673

(22) Filed: Mar. 22, 2017

Related U.S. Application Data

(60) Provisional application No. 62/352,345, filed on Jun. 20, 2016.

(51) Int. Cl.

| | |
|---|---|
| ***A47C 21/00*** | (2006.01) |
| ***A47C 19/02*** | (2006.01) |
| ***F21V 33/00*** | (2006.01) |
| ***F21V 21/15*** | (2006.01) |
| ***F21V 21/30*** | (2006.01) |
| ***F21V 23/00*** | (2015.01) |
| *F21W 131/301* | (2006.01) |
| *F21Y 115/10* | (2016.01) |

(52) U.S. Cl.
CPC ..... *A47C 21/003* (2013.01); *A47C 19/022* (2013.01); *F21V 21/15* (2013.01); *F21V 21/30* (2013.01); *F21V 23/003* (2013.01); *F21V 33/0012* (2013.01); *F21W 2131/301* (2013.01); *F21Y 2115/10* (2016.08)

(58) Field of Classification Search
CPC ..... A47C 21/00; A47C 21/003; A47C 19/005; A47C 19/02; A47C 19/021; A47C 19/022; A47C 19/025; A47C 19/04; A47C 19/045; A61G 7/05; A61G 7/0503; A61G 7/0506; A61G 13/10; A61G 13/101; F21V 33/0012; A47B 97/00; A47B 2220/0077
USPC ... 5/53.1–53.3, 503.1, 658, 905, 279.1, 285, 5/286; 362/130, 127
See application file for complete search history.

(56) References Cited

U.S. PATENT DOCUMENTS 746,188 A * 12/1903 Sonsthagen ..... A61G 7/05 24/335
819,068 A * 5/1906 Ives ..... F21V 33/00 362/130

(Continued)

FOREIGN PATENT DOCUMENTS

EP 0326739 9/1994

OTHER PUBLICATIONS

Lovewardrobes Canis King Size Faux Leather Bed with Integrated LED Headboard Light, http://www.lovewardrobes.com/canis-king-size-faux-leather-bed-with-integrated-led-headboard-light, known at least as early as May 25, 2016, 7 pgs.

(Continued)

*Primary Examiner* — Robert G Santos
(74) *Attorney, Agent, or Firm* — Womble Bond Dickinson (US) LLP

(57) ABSTRACT

A headboard for use with a bed is described. The headboard includes a panel having a top edge, and a light fixture proximate to the top edge. The light fixture can move relative to the panel between a first position and a second position. In the first position, the light fixture emits light in an upward direction away from the bed. In the second position, the light fixture emits light in a downward direction toward the bed.

18 Claims, 8 Drawing Sheets

(56) References Cited

U.S. PATENT DOCUMENTS 1,337,867 A * 4/1920 Whitaker ..... F21S 8/00 248/214
1,739,337 A * 12/1929 Von Canon et al. ... F21V 33/00 362/130
1,835,021 A * 12/1931 Decker ..... A47C 21/003 362/130
1,906,626 A * 5/1933 Kramer ..... F21V 11/00 296/37.1
2,069,561 A * 2/1937 Sandidge ..... F21V 21/14 248/205.1
2,225,727 A * 12/1940 Wallen ..... F21V 33/00 362/130
2,406,029 A * 8/1946 Nettesheim ..... F21V 21/26 248/230.4
2,443,561 A 6/1948 Greenwald
2,443,829 A * 6/1948 Lancry et al. ..... F21S 8/00 362/130
2,612,599 A 9/1952 Matson et al.
2,640,998 A * 6/1953 Myre ..... F21V 21/14 362/130
2,850,622 A 9/1958 Johnson
3,476,926 A * 11/1969 Young ..... F21V 33/0012 362/130
3,919,540 A 11/1975 Burst et al.
4,718,132 A * 1/1988 Wirland ..... A47C 19/045 108/152
D644,049 S * 8/2011 Warren ..... D6/718.13
8,910,333 B2 * 12/2014 Wu ..... A61G 7/05 362/130
2008/0101058 A1 * 5/2008 Smith ..... A47C 21/003 362/130
2010/0319227 A1 * 12/2010 Sanders ..... G09F 7/10 40/546
2012/0198619 A1 * 8/2012 Garcia Garcia ..... A47C 21/00 5/503.1
2013/0198959 A1 * 8/2013 Wu ..... A61G 7/05 5/611

OTHER PUBLICATIONS

Bed and Bath LED Light Kit, Amazon, http://www.amazon.com/bedroom-dresser-headboard-lighting-dimmer/dp/b00b8bwdjq, known at least as early as May 25, 2016, 4 pgs.
Gloria Platform Bed Integrated Lighting Headboard Queen, Target, http://www.target.com/p/gloria-platform-bed-with-integrated-lighting-headboard-queen/-/, known at least as early as May 25, 2016, 3 pgs.

* cited by examiner

ILLUMINATED HEADBOARD

FIELD OF THE DISCLOSURE

The present disclosure relates to furniture and particularly to beds combined with illumination.

BACKGROUND

The desire to have light near a bed is almost universal. Illumination near ones bed may be provided for reading a book prior to falling asleep. Light may be beneficial for safety when a person gets into and out of bed. The concept of a bedside light pre-dates the electric lamp, back to the times of candles and kerosene. More recently, lamps have become common place upon bedside tables. More recently still, small reading lights have become attached or even integrated with the bed itself. There continues, however, to be an effort by furniture designers to create products, including beds, which will excite the purchaser with ever increasing functionality.

SUMMARY

In one embodiment, the present disclosure includes a headboard for use with a bed. The headboard comprises a panel having a top edge, and a light fixture proximate to the top edge. The light fixture is configured to move relative to the panel between a first position and a second position. In the first position, the light fixture emits light in an upward direction away from the bed. In the second position, the light fixture emits light in a downward direction toward the bed.

In another embodiment, the present disclosure includes a headboard for use with a bed comprising a panel having a top edge and a light fixture hinged to the top edge. The light fixture is configured to rotate relative to the panel between a first position and a second position. In the first position, the light fixture emits light in an upward direction away from the bed. In the second position, the light fixture emits light in a downward direction toward the bed. The light fixture rotates approximately 180 degrees from the first position to the second position. In the first position, the light fixture is positioned above the panel to appear continuous therewith. In the second position, the light fixture is positioned in front of the panel.

In another embodiment, the present disclosure describes a bedframe comprising a headboard, a footboard, and an illumination means for selectively emitting light in opposite directions relative to the headboard.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

BRIEF DESCRIPTION OF DRAWINGS

FIG. 5 is an environmental view of a bedframe according to embodiments of the present disclosure in the uplight position with the light sources on.

DETAILED DESCRIPTION OF THE DRAWINGS

Figure 1:
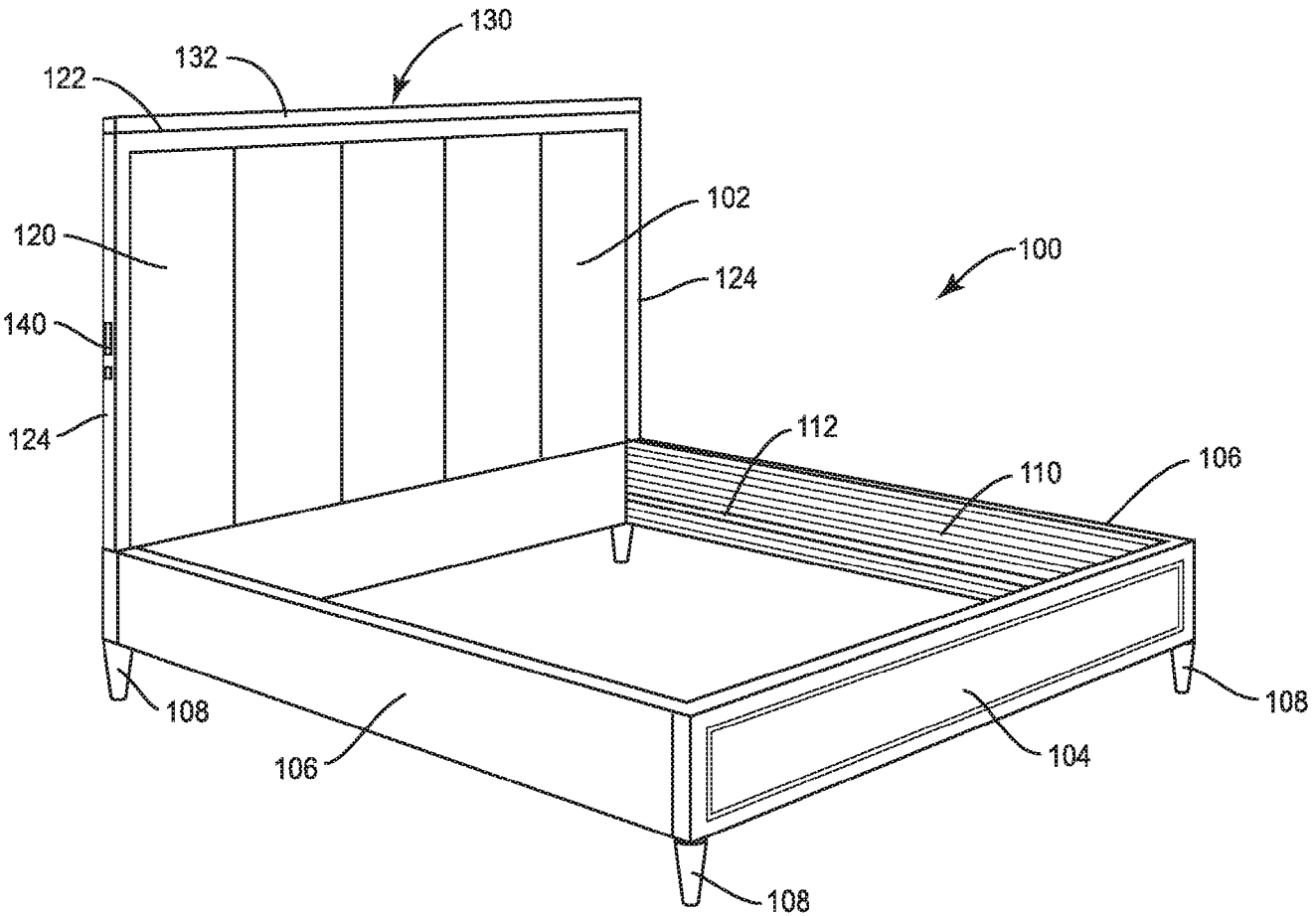
FIG. 1 is a perspective view of a bedframe according to embodiments of the present disclosure.

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

The applicants have developed a bedframe whose headboard includes integrated lighting that may be adjustable not only in color and intensity, but also in direction. Embodiments of the present disclosure include a bed whose headboard includes an integrated light fixture configured to rotate to provide both up-lighting for general illumination or wall lighting, while also providing down-lighting for use while reading or other activities.

Referring to the figures collectively, the present disclosure relates to a bedframe 100 with improved functionality. The bedframe 100 includes at least a headboard 102. The bedframe 100 may optionally also include a footboard 104 and a pair of side rails 106 connecting the headboard 102 to the footboard 104. Often, the bedframe 100 will also include a plurality of feet 108.

If present, as shown in FIG. 1, the side rails 106 may include a series of parallel slots 110 configured to selectively receive one or more brackets or support bars 112. The support bars 112, when installed, are configured to support a mattress or its platform. By selectively inserting the support bars 112 into the desired set of slots 110, the height of the mattress can be adjusted up or down. In one embodiment, the slots 110 are spaced apart by approximately one inch from one another. Therefore, the slots 110 would be configured to provide for adjustability of the mattress height in one-inch increments. In some embodiments, the support bars 112 may be omitted completely, leaving sufficient room between the side rails 106 to accommodate a separate adjustable bed frame.

As shown in the figures, the headboard 102 comprises a panel 120. The panel 120 may be preferably upholstered, but could also be a wooden slab, or other known finished appearances. The panel 120 has a top edge 122. The top edge 122 is preferably linear, but other configurations, such as an arch or semi-circle shape are also contemplated. The panel 120 also includes a pair of side edges 124, which are also preferably linear. Again, other shapes with curvature are also considered. Turned posts may also be provided outside of the side edges 124 relative to a width direction of the headboard 102.

The headboard 102 also includes one or more light fixtures 130 attached proximate to the top edge 122 of the panel 120, resulting in a headboard with integrated illumination. The illumination function of the headboard 102 provides even more functionality than the adjustable side rails 106 alone. In the illustrated embodiment, a single light fixture 130 is provided in the form of a light bar along substantially the entire width of the headboard 102. A single light fixture 130 may comprise one or more light sources (not shown), preferably at least two light sources. Alternatively, two light fixtures 130 may be provided with one or more light sources each. Each light fixture 130 can be attached to the top edge 122 of the panel 120 in a hinged or pivoted manner to allow the light fixture 130 to rotate between an uplight position shown in FIG. 2 and a downlight position shown in FIG. 3.

As used herein, a light fixture 130 is defined by a housing 132 that is independently movable with respect to the panel 120 of the headboard 102. As used herein, a light source is defined as an independently controllable light emitter. One light source may in fact be comprised of a plurality of individual light emitters. For example, a LED light bulb has a plurality of light emitting diode chips. The light source may also be in the form of other known light emitting technologies, such as OLED panels.

Figure 6:
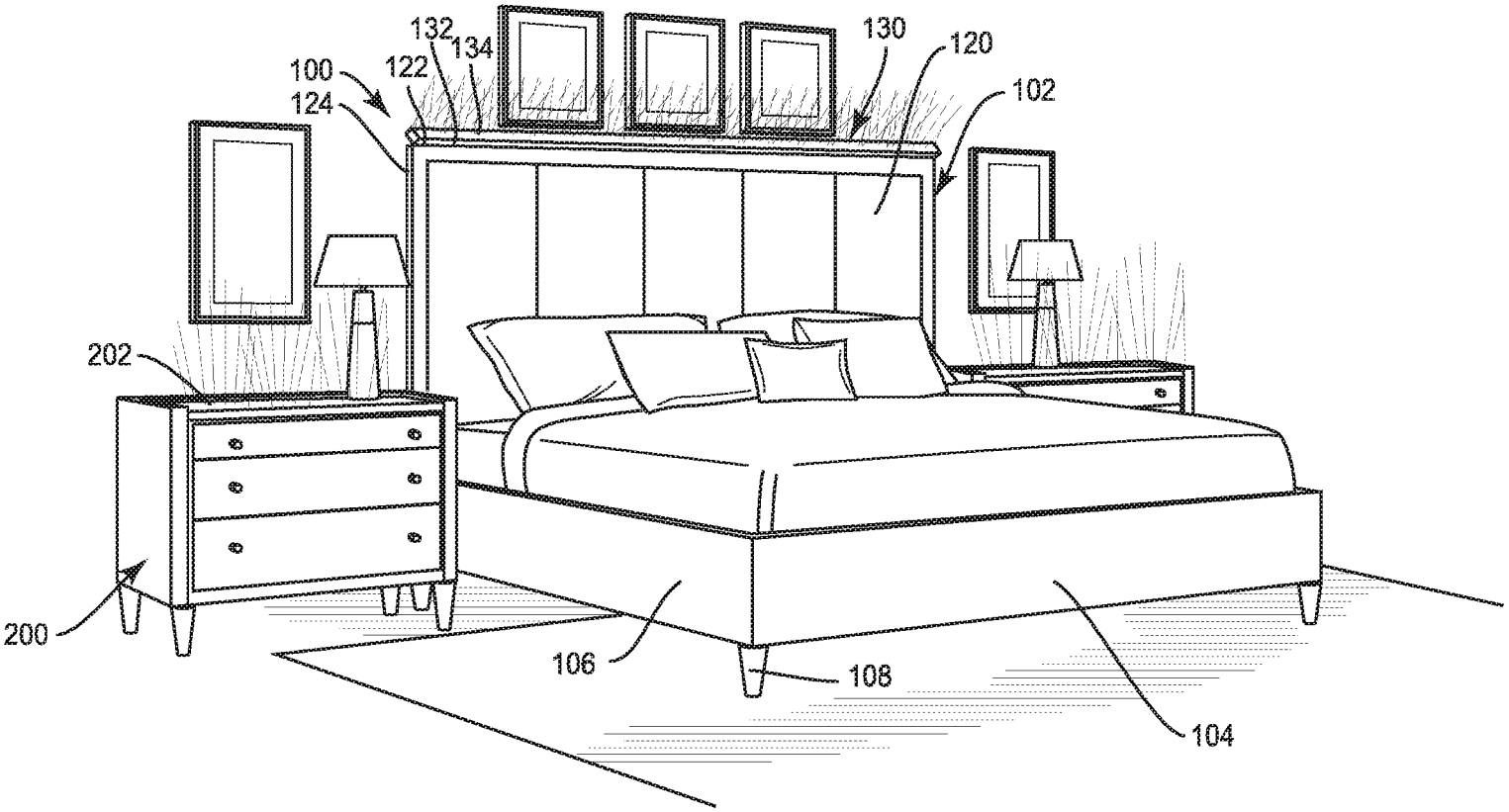
FIG. 6 is an environmental view of a bedframe according to embodiments of the present disclosure with a light fixture in transition between the uplight position and the downlight position.

FIG. 6 shows that the light fixture 130 includes an opening for emitting light, for example covered by a lens 134. The lens 134 may be transparent or translucent. The lens 134 may be optically flat, may be curved, or may be prismatic to bend the emitted light. Where the light source is an OLED panel, a separate lens 134 may be omitted.

Figure 2:
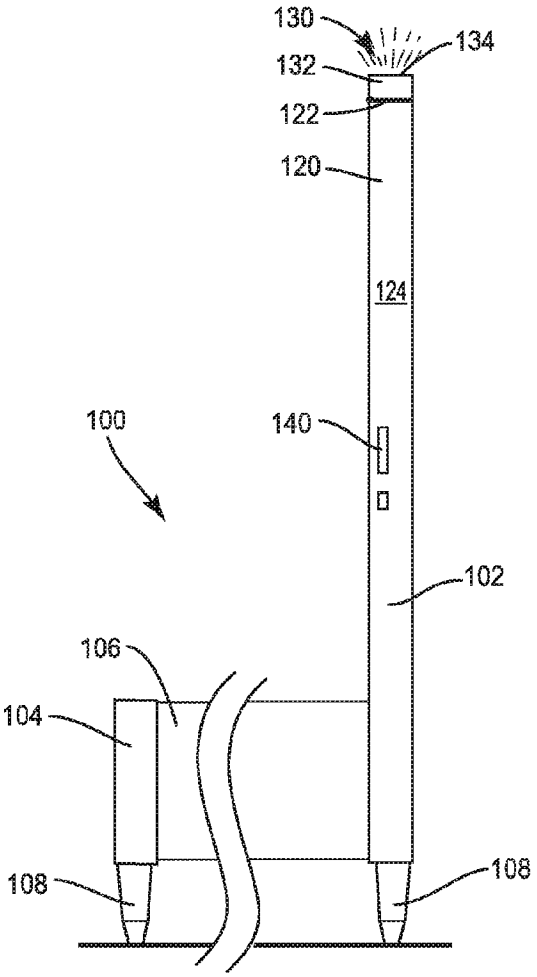
FIG. 2 is a side view of a bedframe according to embodiments of the present disclosure in an uplight position.
Figure 4:
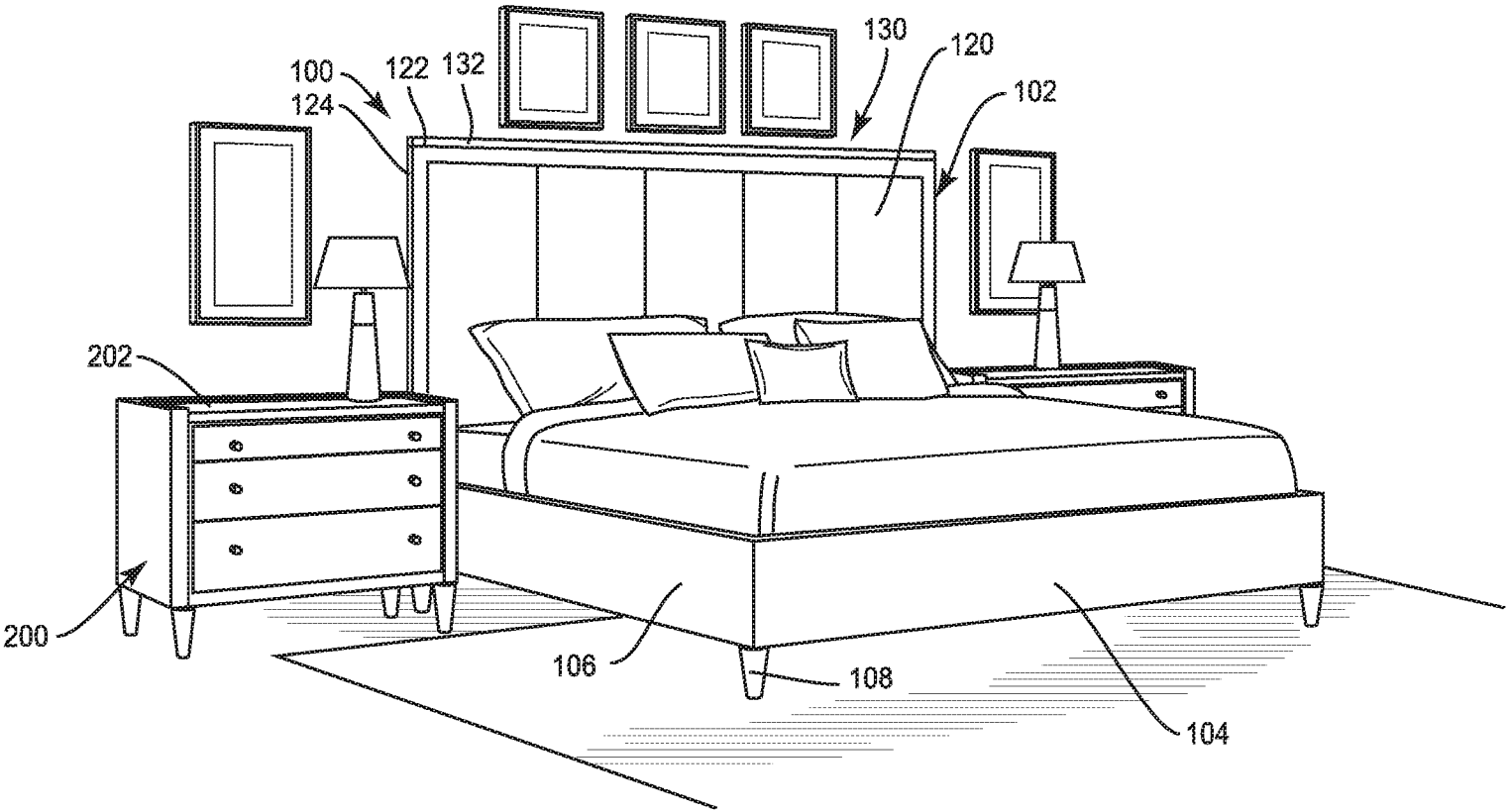
FIG. 4 is an environmental view of a bedframe according to embodiments of the present disclosure in an uplight position.

FIG. 2 shows the headboard 102 with the light fixture 130 in the uplight position. In the illustrated embodiment, the housing 132 of the light fixture 130 is positioned along the top edge 122 of the panel 120. Light rays directed upward through the lens 134 are illustrated in FIG. 2. In the preferred illustrated embodiment, the light fixture 130 is designed to have a side-profile with a similar depth as the headboard 102 so that, in the uplight position, the light fixture appears to be a continuation of the panel 120.

Figure 3:
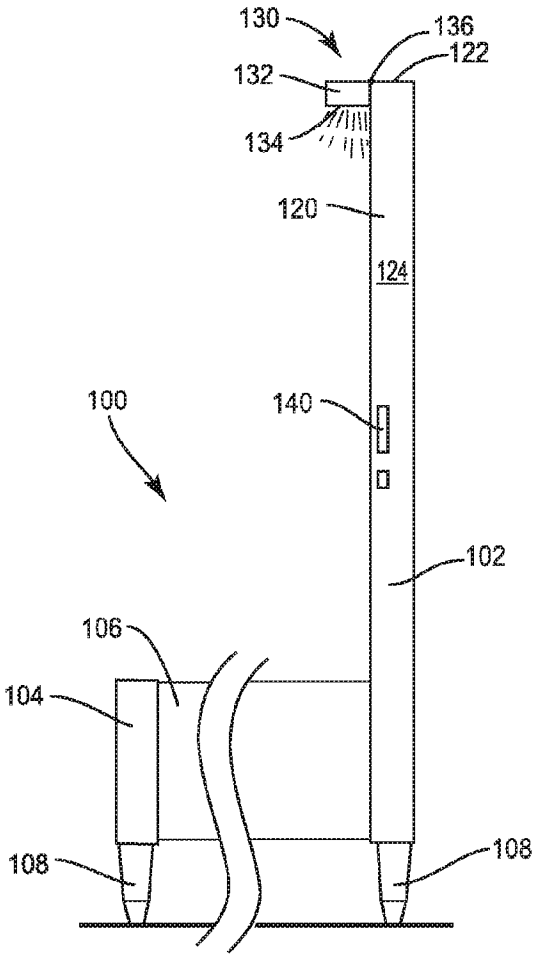
FIG. 3 is a side view of a bedframe according to embodiments of the present disclosure in a downlight position.

FIG. 3 shows the headboard 102 with the light fixture 130 in the downlight position. In the downlight position, the light fixture 130 has been rotated substantially 180 degrees relative to the top edge 122 of the panel 120 such that the lens 134 faces downward, allowing light passing out of the housing 132 through the lens 134 to be directed substantially downward as illustrated by light rays shown in FIG. 3. In the downlight position, the light fixture 130 is positioned in front of the panel 120 of the headboard 102.

In one embodiment, the light fixture 130 may be attached to the top edge 122 of the panel 120 by a hinge 136 (see FIG. 3). In one embodiment, the light fixture 130 may be pivoted between the uplight position and the downlight position manually, simply by holding onto the fixture and rotating the fixture around the pivot point of the hinge 136. Movement of the light fixture 130 from the uplight position to the downlight position is not limited to pivoting around a fixed axis as found in a hinge. Other joints or linkages that provide for motion between an upward facing first position substantially directly above the panel 120 to a second position facing downwardly and positioned in front of the panel are also applicable.

In another embodiment, the light fixture 130 will pivot between the uplight position and the downlight position with the assistance of a powered actuator. For example, a drive arm may be attached to the light fixture 130 on one end, and be operably driven by a small electric motor (not shown) at another end. Rotation of the electric motor could result in rotation of the light fixture 130 from the uplight position to the downlight position and vice versa. Gears or other connections may be used to operably link the motor to the drive arm. The drive arm may be arcuate with its center of curvature positioned to correspond with the hinge axis of the light fixture 130 relative to the panel 120. Other motor driven embodiments are contemplated and would be understood by others skilled in the art.

In one embodiment, control of the operation of the light sources of the light fixture 130 may be provided by control panels 140 located along the side edges 124, or other opposite portions of the panel 120. The control panels 140 may control the position of the light fixture 130 in embodiments where the light fixture is moved with a powered actuator. In a preferred embodiment, a control panel 140 will be provided on each side edge 124 to allow control from either side of the bed. The control panels 140 may include a USB port or other power sockets to allow charging of a mobile device, for example. The control panels 140 may control features such as: the position of the light fixture 130, the intensity of the light sources, the color of the light sources, or the arrangement of the lit light sources (e.g. the illumination pattern).

The control of the light fixture 130 may also be provided remotely, such as through software (e.g., a mobile application) installed on a mobile device such as the owner's phone or tablet computer. The light fixture 130, the headboard 102, or the bedframe 100, may communicate through Wi-Fi, Bluetooth, or other close range wireless communication technology. The light fixture 130 may also be operated through control and communication with health monitoring systems such as a Fitbit or other health monitoring sensors included or added into association with the bedframe 100. The light fixture 130 may also coordinate or be otherwise controlled by smart home technologies and interfaces integrated within the home, such as Nest.

The software associated with each embodiment of a controller discussed above may be configured to operate the light fixture 130 in response to the owner's preferences, producing a predetermined initial setting dependent on which user initially turns on the light fixture 130. The software may allow for the operation of the light fixture 130 to be controlled automatically, such as turning off at a given time, or functioning as an alarm clock with increasing brightness at a given time. In one example, light has a significant impact upon the regulation and influence of the user's circadian rhythms. The color and intensity of the light may be varied in accordance with these circadian rhythms to assist the user with optimizing their sleep.

In yet other embodiments, a motion or other sensor may be operably combined with the control panel 140 to detect a person entering the room to turn on the light fixture 130 or automatically shut off the light fixture if no motion is detected after a predetermined period of time.

Figure 5:
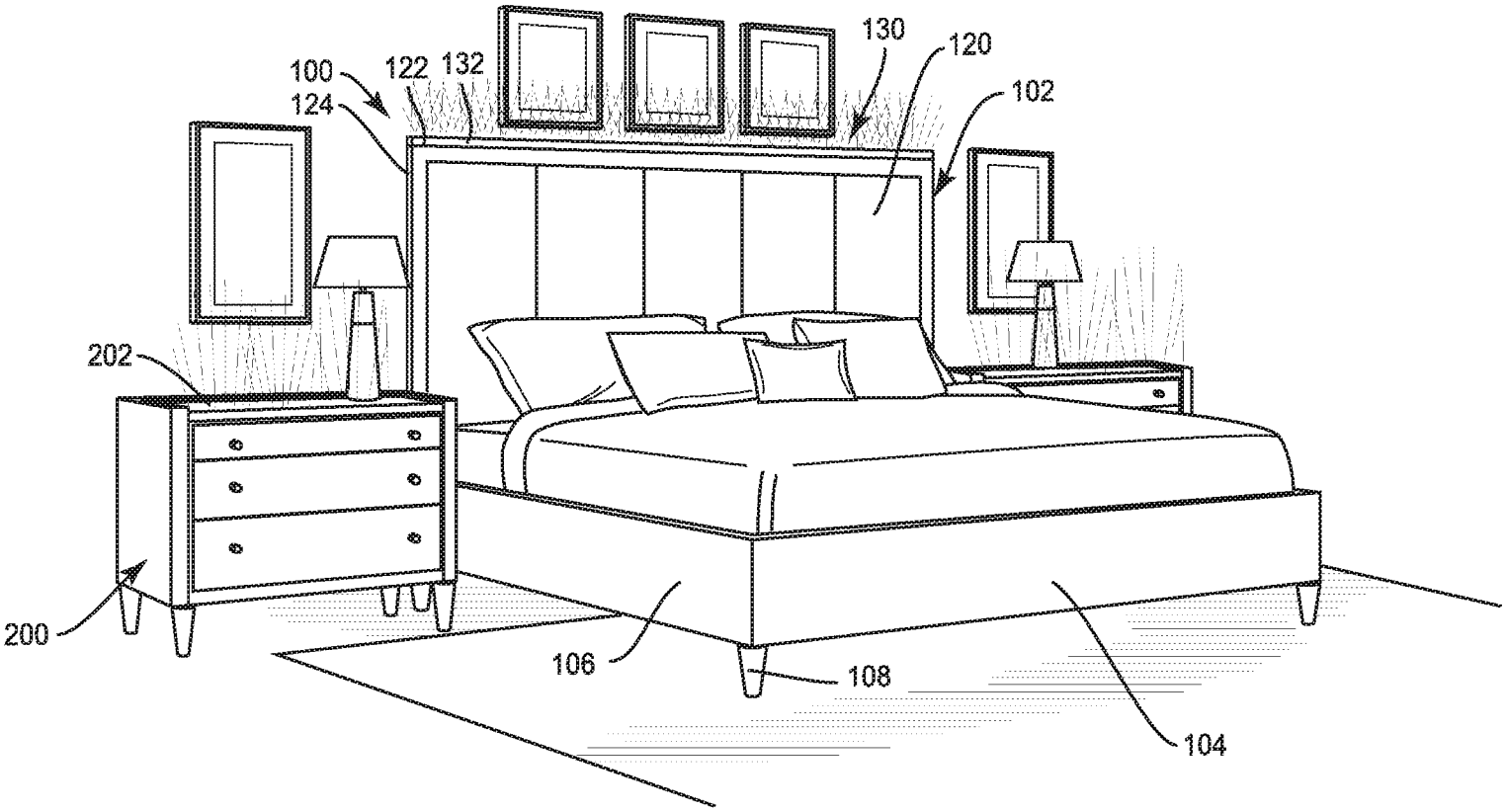
Figure 7:
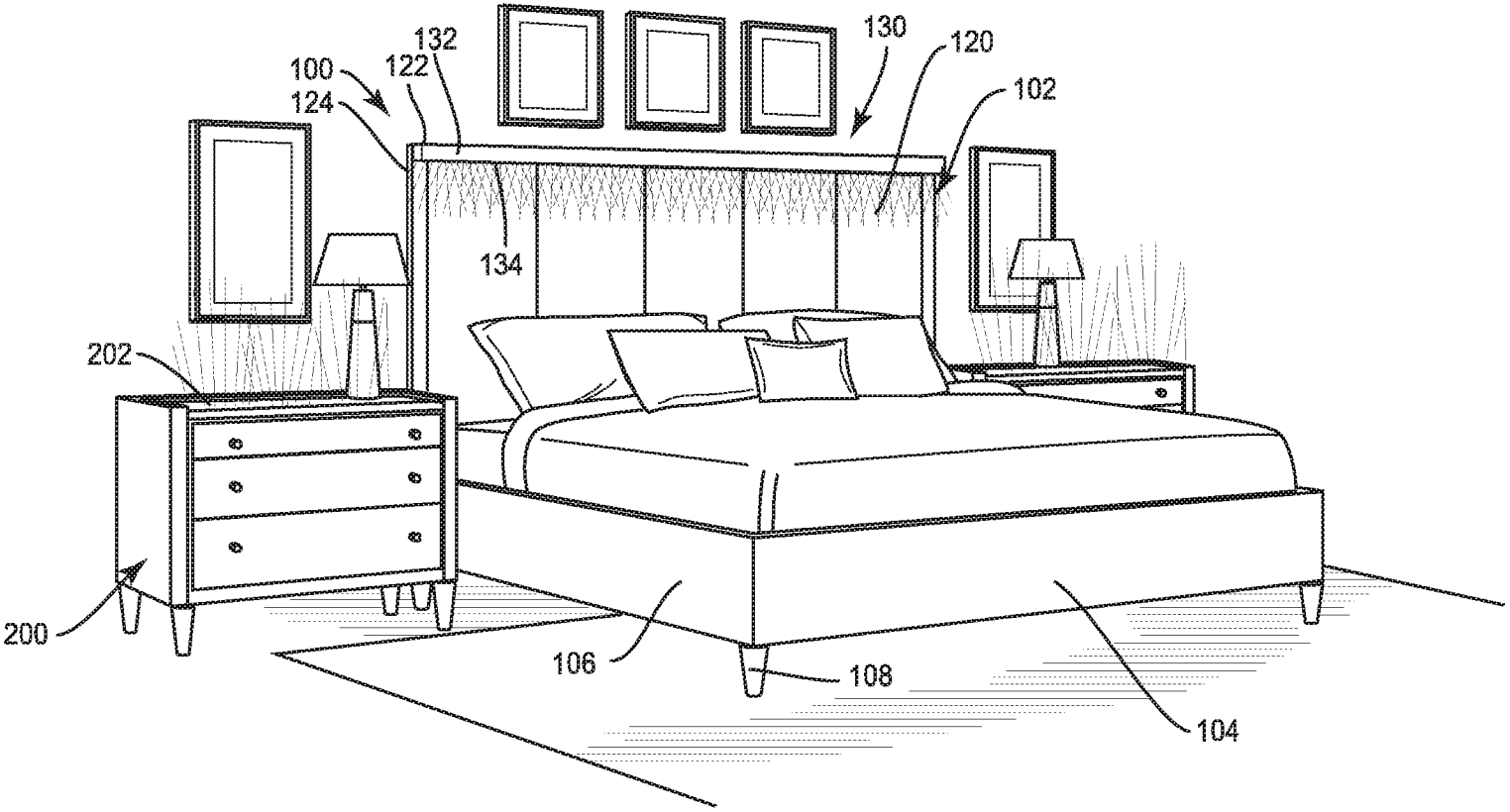
FIG. 7 is an environmental view of a bedframe according to embodiments of the present disclosure in the downlight position with the light sources on in a first pattern.
Figure 8:
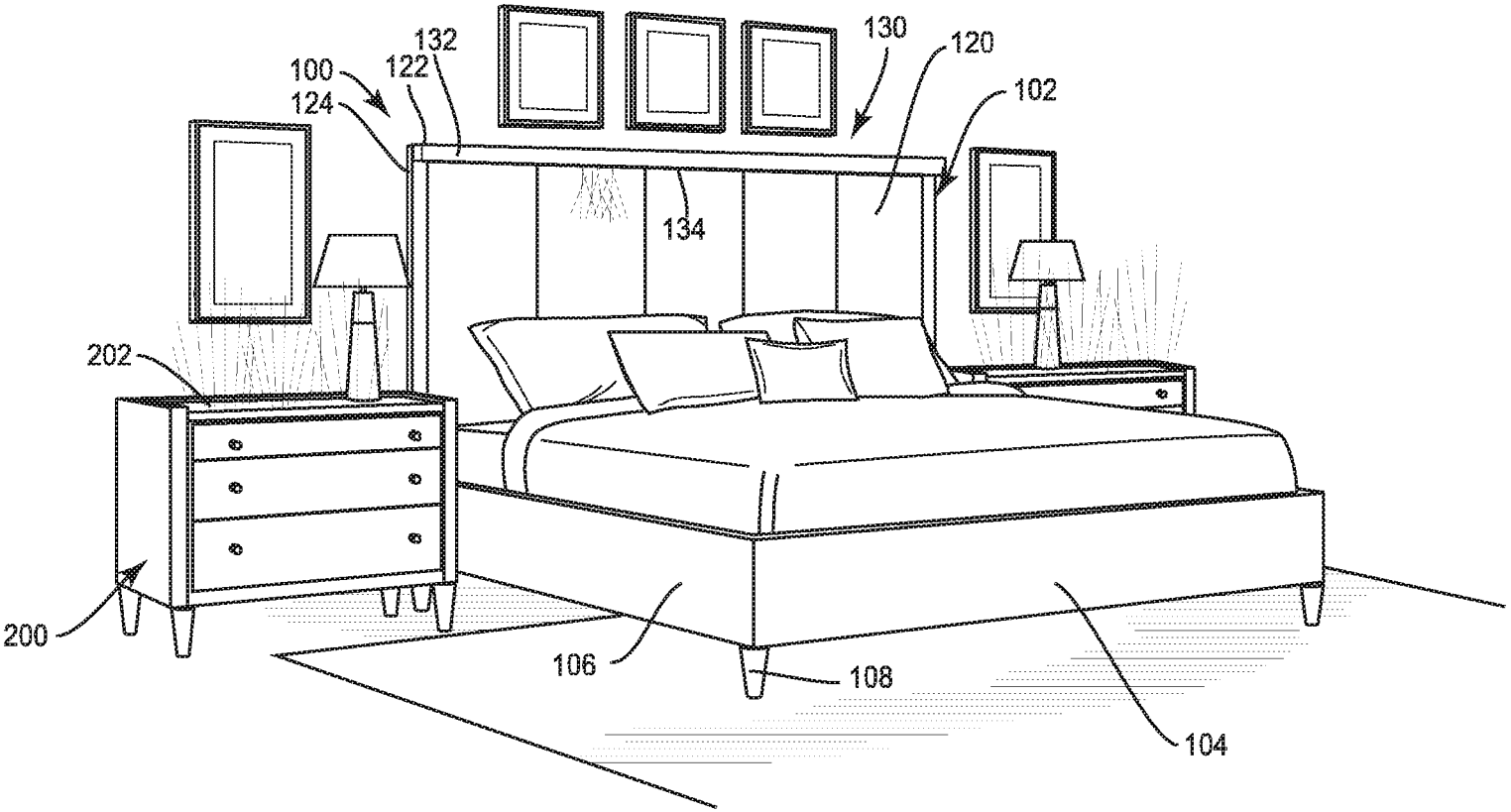
FIG. 8 is an environmental view of a bedframe according to embodiments of the present disclosure in the downlight position with the light sources on in a second pattern.
Figure 9:
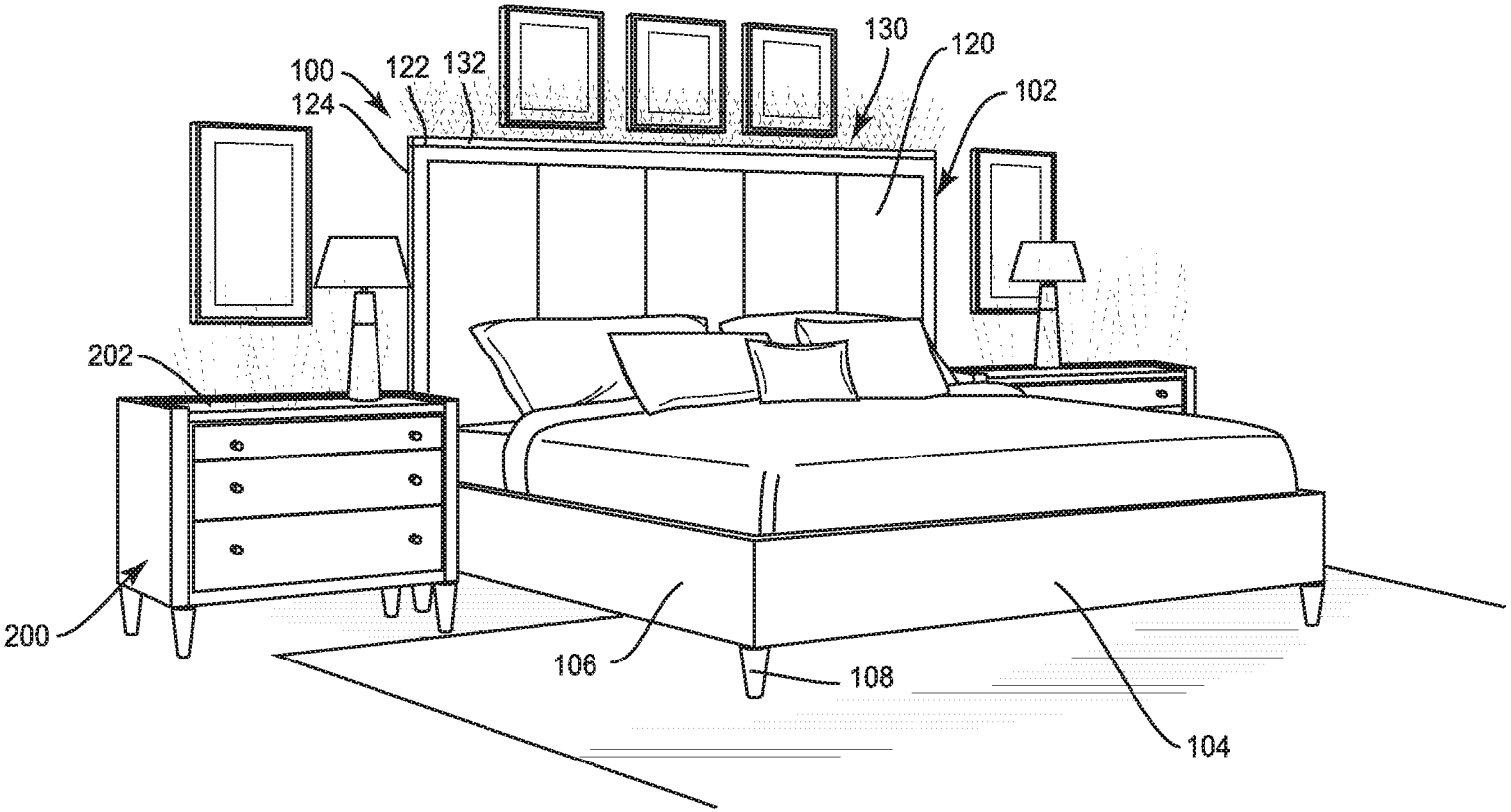
FIG. 9 is an environmental view of a bedframe according to embodiments of the present disclosure in the uplight position with the light sources generating an alternative color.

Some of the functions controlled by the control panel 140 can be seen in the figures. For example, FIG. 5 shows the light fixture 130 in the uplight position with the light sources lit across the full width of the bed. FIG. 6 shows the light fixture 130 being rotated between positions. FIG. 7 shows the light fixture 130 in the downlight position with the light sources lit across the full width of the bed. FIG. 8 shows an example where the light sources are provided in a reading light mode in which the light sources are controlled independently so that the light sources can be illuminated over only one side of the bed. FIG. 9 shows an example where the light sources have been controlled to produce an alternative color. Electronically controlled light sources capable of a plurality of colors, variable intensities, patterns and independent control by a control panel or mobile software application are generally known in the art. Examples of suitably controllable light sources include but are not limited to products available from Ilumi of Plano, Tex. and Nanoleaf of Toronto, ON Canada.

As seen in FIGS. 5-9, the light source and light fixture 130 may be configured to communicate and provide coordinated operation with other sources of illumination provided throughout a bedroom. For example, the light fixture 130 may coordinate operation with a floor lamp having smart light source technology. Additionally, the nightstands 200 may be constructed with a lens 202 as their top surface. A light source provided below the lens 202 of the nightstand 200 may be similarly operated in coordination with the light fixture 130 of the headboard 102 with respect to color, brightness, etc.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. A headboard for use with a bed, comprising:
a panel having a top edge; and
a light fixture hinged to the top edge such that the light fixture rotates along the top edge and is configured to move relative to the panel between a first position and a second position,
wherein, in the first position, the light fixture emits light in an upward direction away from the bed, and
wherein, in the second position, the light fixture emits light in a downward direction toward the bed.

2. The headboard of claim 1, wherein the light fixture rotates approximately 180 degrees,
wherein, in the first position, the light fixture is positioned above the panel, and
wherein, in the second position, the light fixture is positioned in front of the panel.

3. The headboard of claim 2, wherein in the first position, the light fixture appears to be a continuation of the panel.

4. The headboard of claim 1, wherein the light fixture is rotated by a motor.

5. The headboard of claim 4, wherein the motor is operated by a pair of control panels located on opposite sides of the panel.

6. The headboard of claim 5, wherein the pair of control panels each comprises a USB port.

7. The headboard of claim 1, wherein the light fixture comprises a plurality of independently controllable light sources.

8. The headboard of claim 7, wherein the plurality of independently controllable light sources have variable color and intensity.

9. The headboard of claim 8, wherein the plurality of independently controllable light sources are controlled with software installed within at least one of a mobile electronic device, a health monitoring system and a smart home device.

10. The headboard of claim 9, wherein the plurality of independently controllable light sources are controlled in color and intensity in association with circadian rhythms.

11. A bedframe, comprising:
a headboard according to claim 1;
a footboard; and
a pair of side rails connecting the headboard to the footboard.

12. The bedframe of claim 11, wherein the pair of side rails each comprise a plurality of parallel slots selectively receiving a support bar for a mattress, wherein a height of the mattress is adjustable by selecting which of the plurality of parallel slots receives the support bar.

13. The bedframe of claim 12, wherein the plurality of parallel slots are spaced apart from one another by approximately one inch.

14. A headboard for use with a bed, comprising:
a panel having a top edge; and
a light fixture hinged along the top edge,
wherein the light fixture is configured to rotate relative to the panel between a first position and a second position,
wherein, in the first position, the light fixture emits light in an upward direction away from the bed,
wherein, in the second position, the light fixture emits light in a downward direction toward the bed,
wherein the light fixture rotates approximately 180 degrees from the first position to the second position,
wherein, in the first position, the light fixture is positioned directly above the panel to appear continuous therewith, and
wherein, in the second position, the light fixture is positioned in front of the panel.

15. The headboard of claim 14, wherein the light fixture comprises a plurality of independently controllable light sources.

16. The headboard of claim 15, wherein the plurality of independently controllable light sources have variable color and intensity.

17. The headboard of claim 16, wherein the plurality of independently controllable light sources are controlled with software installed within at least one of a mobile electronic device, a health monitoring system and a smart home device.

18. The headboard of claim 17, wherein the plurality of independently controllable light sources are controlled in color and intensity in association with circadian rhythms.

* * * * *